United States Patent [19]

Goldfarb

[11] 4,266,774

[45] May 12, 1981

[54] COMPETITIVE GAME APPARATUS

[76] Inventor: Adolph E. Goldfarb, 4614 Monarca Dr., Tarzana, Calif. 91356

[21] Appl. No.: 10,924

[22] Filed: Mar. 12, 1979

[51] Int. Cl.[3] ..... A63F 3/00; G04B 5/20

[52] U.S. Cl. ..... 273/275; 273/148 R; 368/3

[58] Field of Search ..... 58/141, 145 D, 145 K; 273/1 G, 1 H, 1 I, 267, 275, 290, 148 R; 35/22 A

[56] References Cited

U.S. PATENT DOCUMENTS

| | | | |
|---|---|---|---|
| 3,404,890 | 10/1968 | Christy | 273/275 X |
| 3,710,455 | 1/1973 | Liversidge | 35/22 A |
| 3,760,511 | 9/1973 | Matsumoto | 35/22 A |
| 3,804,415 | 4/1974 | Ryan | 273/275 |
| 3,834,701 | 9/1974 | Hashimoto | 273/DIG. 26 X |
| 3,990,698 | 11/1976 | Barlow | 273/1 R |
| 4,047,720 | 9/1977 | Galdal | 273/275 |
| 4,117,666 | 10/1978 | Aguilar | 58/141 X |

FOREIGN PATENT DOCUMENTS

| | | | |
|---|---|---|---|
| 539295 | 3/1977 | U.S.S.R. | 58/145 D |

*Primary Examiner*—Harland S. Skogquist
*Attorney, Agent, or Firm*—Romney, Schaap, Golant, Disner & Ashen

[57] ABSTRACT

A competitive game apparatus comprised of a game board having a playing surface with a plurality of intersecting playing paths on which playing pieces may be positioned. Two or more players are each provided with a set of the playing pieces which are distinguishable from the playing pieces of the other player by indicia, as for example the color of the playing pieces. The players alternate in playing pieces on the paths, with each player attempting to extend a continuous strip of his or her player pieces while attempting to block the further extension of the strips of his opponents. A timer may be provided with each player required to complete his or her turn in a preestablished time period. This imposes a tempo on the play. Particularly when the game is played at a very fast tempo, the playing pieces already on the board tend to be inadvertently displaced, and it is desirable that the board and/or the playing pieces be constructed to detachably maintain the pieces where they are placed on the surface. The player who succeeds in preventing the opponent player from making any further moves wins the game or achieves a score. The playing pieces may be of different lengths so that the players must choose among playing pieces as well as choosing positions on the playing surface to occupy.

4 Claims, 9 Drawing Figures

COMPETITIVE GAME APPARATUS

BACKGROUND OF THE INVENTION

1. Field of the Invention

This invention relates in general to certain new and useful improvements in competitive games, and more particularly to games in which each player is provided with a plurality of playing pieces for positioning on a game board along selected paths while attempting to block the progress of the opponent player or players.

2. Brief Description of the Prior Art

There are games in the prior art in which one player attempts to block the opponent player from further movement. A typical game of this type was called "Trap." Each player had a number of player pieces movable on a game board. In addition blocking pieces were provided. The players alternated turns and at each turn a player could move his or her playing pieces and/or place blocking pieces on the board in an effort to block or trap the opponent playing pieces.

There has been a coin operated electronic game in which two or more players controlled moving lines or strips of light on an electronic screen in a manner to block the movement of the opponent player or players. The light lines or strips moved simultaneously and continuously, and at a rate independently of the players, and the players could only control the path of movement of the light strips. Each player was provided with a separate manually operable control lever which controlled the path of movement of his or her light strip. Each player attempted to manipulate his or her own control in order to move the light strip in a manner to block further movement by the one or more opponent players.

OBJECTS OF THE INVENTION

It is, therefore, a primary object of the present invention to provide a game apparatus comprised of a game board and a plurality of playing pieces for each of the players and in which each player attempts to position his or her playing piece on the game board in a continuous strip and in an attempt to block an opponent player or players from further movement.

It is also an object of the present invention to provide a game apparatus of the type stated which operates as a time reaction game and in which each player attempts to position its playing pieces on the game board during a preselected time frame established by a timing mechanism.

It is another object of the present invention to provide a game apparatus of the type stated in which each player attempts to place its playing pieces on a game board which is provided with spaces defining desired playing piece paths of movements.

It is a further object of the present invention to provide a game apparatus of the type stated in which each player is provided with playing pieces of various lengths so that each player may properly select a playing piece of desired length and then place that selected playing piece in a proper playing piece location in order to form the continuous strip of his or her playing pieces.

It is an additional object of the present invention to provide a game apparatus of the type stated in which the playing pieces of each player and the game board are constructed so that each playing piece may be detachably positioned on the game board.

It is another salient object of the present invention to provide a method of playing a game in which each of a plurality of opponent players selects a playing piece encoded to identify that player and places the selected playing piece of a game board in a desired position in order to create a continuous strip of that player's playing pieces and in an attempt to block movement of the opponent player or players.

It is yet another object of the present invention to provide a game apparatus of the type stated which can be played by players of various ages and skills and with a handicap capable of being applied to one or more of the opponent players.

With the above and other objects in view, my invention resides in the novel, features of form, construction, arrangement and continuation of parts presently described and pointed out in the claims.

SUMMARY OF THE DISCLOSURE

The invention relates in general to certain new and useful improvements in game apparatus comprising a game board and a plurality of playing pieces for each of a plurality of opponent players, and in which each player attempts to continue to place that player's playing pieces on the game board while attempting to block one or more opponent players from further movement. In a preferred aspect, the game apparatus functions on a time reaction basis where the opponent players are required to place the playing pieces on the game board in a preestablished time frame.

Each player is provided with a plurality of playing pieces and which are distinguishable from the playing pieces of one or more opponent players by certain indicia, as for example, colors or the like. The players take turns in placing their playing pieces on the game board, with each player forming a continuous strip of his or her playing pieces. More particularly, a player attempts to place his or her playing piece adjacent to a particular playing piece already on the board and preferably adjacent to the playing piece or the strip which was last placed on the board. Further, each player attempts to cause his or her strip of playing pieces to follow a selected path which both permits that strip to be continued and blocks the continuation of the strips of one or more opponent players.

As indicated previously, the game apparatus may incorporate a time reaction feature. For this purpose the game apparatus may be provided with a timer mechanism as for example, a conventional mechanically operable wind-up time mechanism. This timer mechanism establishes a predetermined time interval for each player to place his or her playing piece on the board. In one form of the game apparatus, the timer mechanism is mounted on the game board in a convenient location where it is accessible for all players, e.g., in the center of the game board. In this way, each player may start the time interval for the next player by actuating the timer mechanism as for example by pushing a release button on the timer mechanism.

Particularly when the game is played as a time reaction game and hands are moving quickly so that pieces on the board tend to get displaced by accident, it is desirable that the playing pieces be detachably maintained in position on the game board. Various forms of detachably mounting the playing pieces on the game board may be employed, as for example, one or more projections on the playing pieces or the game board and receptacles on the other to receive the projections.

Other examples are a high friction surface on the game board and/or the bottoms of the playing pieces, adhesive strips on the bottom surfaces of the playing pieces, or the like.

The illustrated game board generally comprises a rectangular playing surface with two or more adjacent opponent player starting areas. The playing surface has a plurality of spaces defining a plurality of intersecting paths for the playing pieces.

The illustrated rectangular playing surface is divided by a grid of parallel and perpendicular lines to define equal square spaces. The spaces thus extend in parallel rows across the surface between each pair of opposed sides of the surface. The illustrated playing pieces are made up of one or more units, with each unit being square and generally conforming to one of the spaces on the playing surface. Thus, if a single playing piece is made up of more than one unit, it will occupy that number of spaces on the playing surface. In one embodiment the playing pieces of multiple units have the units arranged in a straight line. Thus, a three unit piece would occupy three linearly arranged spaces on the playing surface. The playing pieces are configured, so that when two pieces are positioned adjacent to one another, they will form a generally continuous strip. This is a highly preferred visual aspect of the game. The illustrated square unit pieces have one or more square units of equal size and form a continuous rectangular strip when the pieces are placed end to end.

The illustrated arrangement of square spaces define paths that extend parallel and perpendicular to one another, but not at other angles.

Each player is provided with a plurality of playing pieces of different lengths. Thus, for example, each player may have a plurality of playing pieces of one unit which spans one space on the playing surface, a plurality of playing pieces of two units which span two spaces, a plurality of playing pieces of three units which span three spaces, etc. At each player's turn, he or she must select one or more pieces of particular lengths and place them in particular locations on the playing surface.

This invention possesses many other advantages and has other purposes which may be made more clearly apparent from a consideration of forms in which it may be embodied. These forms are shown in the drawings accompanying and forming part of the present specification. They will now be described in detail, for the purposes of illustrating the general principles of the invention, but it is to be understood that such detailed descriptions are not to be taken in a limiting sense.

BRIEF DESCRIPTION OF THE DRAWINGS

Figure 1:
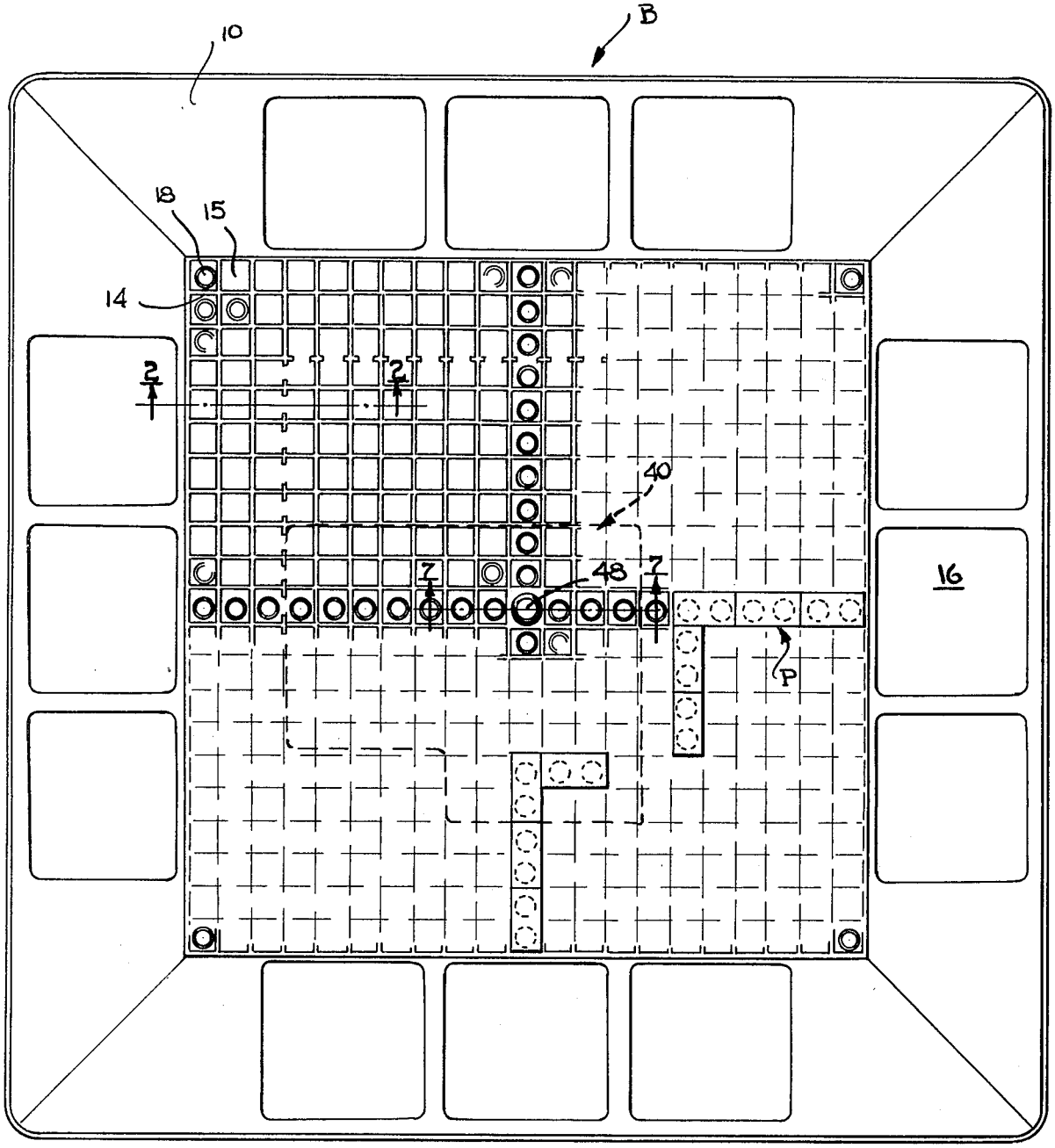
Figure 6:
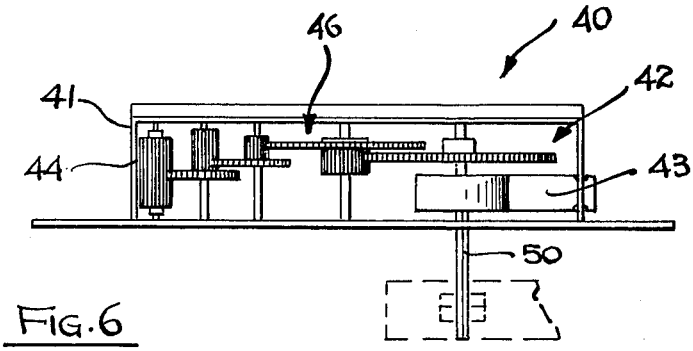
Figure 2:
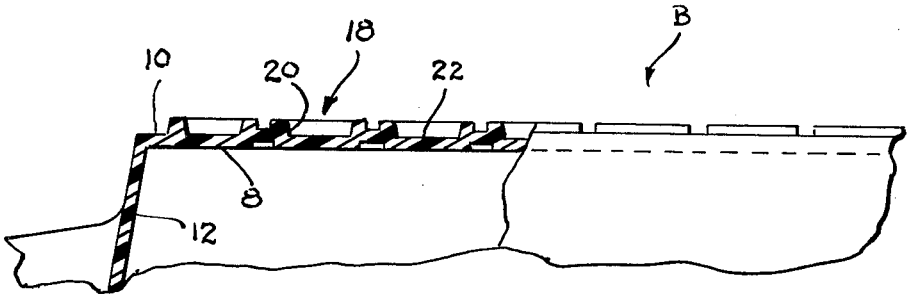
Figure 3B:
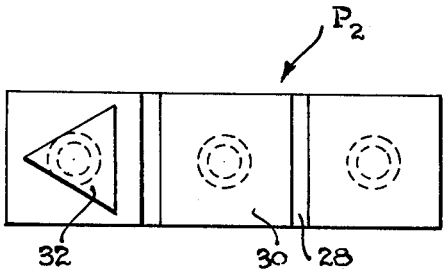
Figure 3A:
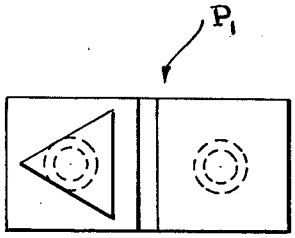
Figure 3C:
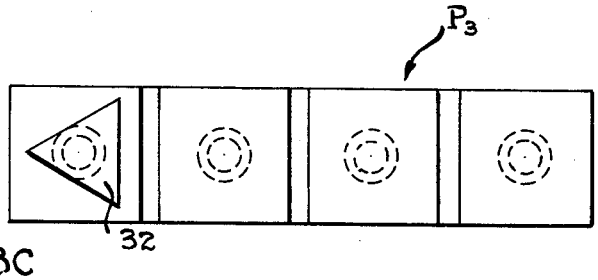
Figure 5:
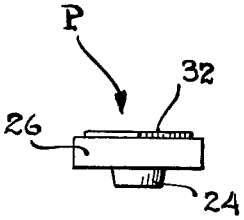
Figure 4:
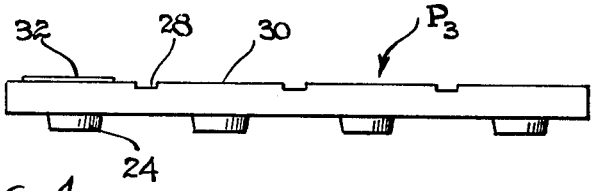
Figure 7:
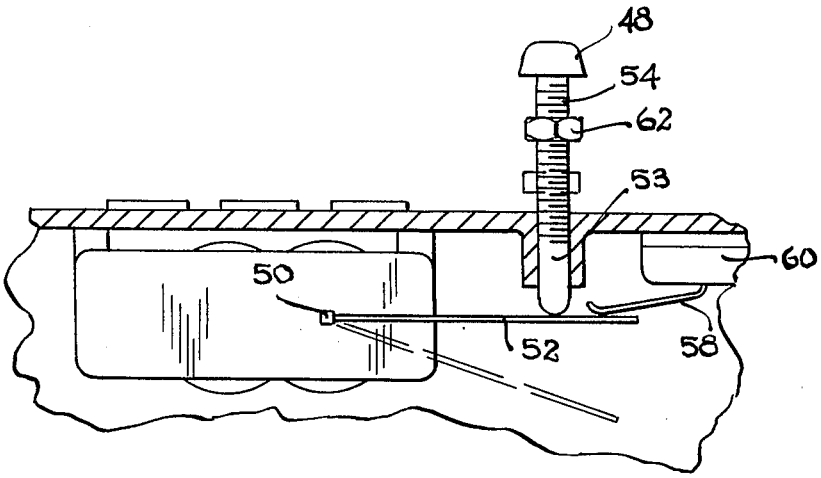

Having thus described the invention in general terms, reference will now be made to the accompanying drawings in which:

FIG. 1 is a top plan view of a game apparatus constructed in accordance with and embodying the present invention and showing a game board with a plurality of playing pieces located thereon;

FIG. 2 is a fragmentary vertical sectional view showing the construction of the game board of FIG. 1, and taken along line 2—2 of FIG. 1;

FIG. 3A is a top plan view of one of the playing pieces namely a two space playing piece, which may be used in the game apparatus of the present invention;

FIG. 3B is a top plan view, similar to FIG. 3A, of a three space playing piece which may be used in the game apparatus of the present invention;

FIG. 3C is a top plan view, similar to FIG. 3A, of a four space playing piece which may be used in the game apparatus of the present invention;

FIG. 4 is a side elevational view of the playing piece of FIG. 3C;

FIG. 5 is an end elevational view, of one of the playing pieces of the present invention;

FIG. 6 is a schematic side elevational view of a timing mechanism used with the game apparatus of FIG. 1; and FIG. 7 is a vertical sectional view taken along line 7—7 of FIG. 1.

DETAILED DESCRIPTION OF A PREFERRED EMBODIMENT

Referring now in more detail and by reference characters to the drawings which illustrate a preferred embodiment of the present invention, B designates a game board having a generally flat horizontally disposed wall 8 with its upper surface representing a playing surface 10. Along its peripheral margin, the wall 8 is integrally formed with a downwardly extending leg section 12 which is adapted to engage a table or other supporting surface (not shown).

The playing surface 10 is provided with a plurality of mutually perpendicular lines 14, which create generally square shaped spaces or so-called playing piece locations 15, define permissible paths of movement for playing pieces, as hereinafter described in more detail. The play of the game could start at any desired location on the game board. However, the game board could be provided with two or more player starting positions. In one embodiment, at least four player starting positions or areas are provided on the game playing surface 10, with one being located at the center of each of the four sides. However, it should be understood that two or more player starting locations could be provided on each side of the game playing surface. In the illustrated embodiment of the game apparatus, the playing surface 10 is rectangular in shape although the game board could adopt other shapes.

The game board is provided with three recesses in the form of playing piece receiving bins 16 in the manner as illustrated in FIG. 1. In the illustrated embodiment of the game apparatus, each player may be provided with three different sets of playing pieces. Thus, each player would be provided with a different bin for different sets of playing pieces. Further, if each player were provided with four or more sets of playing pieces, each player would also be provided with four or more bins so that the number of bins correspond to the number of sets of playing pieces for each player.

The game board is provided with a plurality of recesses, with one recess 18 in each playing piece location or space 15, in the manner as illustrated in FIG. 1 of the drawings. The recesses 18 are depressed from the playing surface 10 and are formed by downwardly and inwardly converging side walls 20 which integrally merge into a bottom wall 22. In this way, each of the recesses 18 is designed in order to accommodate projections 24 on each of the playing pieces P hereinafter described in more detail.

Some of the playing pieces P used in the game apparatus are more fully illustrated in FIGS. 3-5 of the drawings. FIG. 3A illustrates, in top plan view, a two position playing piece $P_1$, that is a playing piece which spans or extends across and fits within two playing piece positions 15. FIG. 3B illustrates, in top plan view, a three position playing piece $P_2$, namely one which extends across and fits within three playing piece positions 15, and FIG. 3C is a top plan view of a four position playing piece $P_3$. The end view of each of the playing pieces is illustrated in FIG. 5 since they are all elongate and have the same width. FIG. 4 is a side elevational view of the playing piece $P_3$ of FIG. 3C. The side elevational views of other playing pieces such as the playing pieces $P_1$ and $P_2$ would be similar to that of FIG. 4, although with lesser length corresponding to the number of playing piece locations the playing pieces would span.

It should be understood that in the preferred embodiment of the invention, each player is provided with a plurality (set) of two position playing pieces, a plurality (set) of three position playing pieces, and a plurality (set) of four position playing pieces. Nevertheless, is should be understood that players could be provided with playing pieces capable of being positioned in one playing piece location or five playing piece positions or more than five playing piece positions. Moreover, while each playing piece in accordance with the drawings is capable of spanning playing piece positions in only a straight line, it should be understood that these playing pieces are capable of spanning playing piece positions in paths other than a straight line as for example, arcuate paths, mutually perpendicular paths, angularly disposed paths or the like.

Also in accordance with the drawings, it is to be noted that the playing piece location paths are defined by perpendicular lines, as for example, the lines 14. Nevertheless, it should be understood that diagonal lines could be included or replace the perpendicular lines as shown in order to form different playing path locations. However, it should be recognized that the arrangement as illustrated in FIG. 1 and as described hereinabove is a presently preferred arrangement for the playing piece paths of movement.

Each of the playing pieces comprises a flat sheet as for example, a flat plastic sheet 26 with projections 24 formed on the bottom wall thereof in the manner as illustrated in FIGS. 4 and 5. The projections 24 correspond in shape and size to the board recesses 18. Moreover, each of the playing pieces is provided at its upper wall with one of more transversely extending recesses or grooves 28 to form individual segments 30 corresponding to the number of playing piece locations spanned by the particular playing piece. Thus a three position playing piece would be provided with two longitudinally spaced apart, transversely extending recesses 28 in the manner as illustrated in FIG. 3B of the drawings. Further, each playing piece is provided with an upstanding boss 32 in the shape of an arrow so as to point the direction of the playing piece when placed on the game board.

This boss 32 or other portion of the playing pieces P carry an encoding and preferably a color encoding to identify the playing piece with a particular player. It should be understood the first player would have all of his playing pieces colored, e.g., red, a second player would have all of his playing pieces colored blue, etc.

The game board and the playing pieces may be formed of a number of known plastic materials, as for example, polyethylene, polystyrene, polybutadiene, and any of a number of known vinyl polymers or copolymers. Moreover, the game board and/or playing pieces may be constructed as an integral member in a number of known plastic molding operations, as for example, blow molding, injection molding, thermo-forming, or the like. Further, the game board as well as the playing pieces may be formed of other materials, as for example, various metals, wood, paperboard materials, or the like. Even more so, the game board and/or the playing pieces may be formed of reinforced plastic composite materials as for example, fiberglassepoxy resins, etc.

The game of the present invention may be a time reaction game in the preferred embodiment as aforesaid. For this purpose, the game board is provided with a timing mechanism as for example, the timing mechanism 40 more fully illustrated in FIG. 6 of the drawings.

The timing mechanism 40 may adopt a form of a simple windup timer which comprises a housing 41 having a timer motor, e.g. a conventional spring-operated timer motor 42. The motor 42 comprises a spring band 43 wound under tension and an escapement mechanism 44 operated through a plurality of gears 46.

The timing mechanism 40 is provided with a button 48 which extends upwardly through the game board in the manner as illustrated in FIG. 1. In this case, the button 48 also serves to windup the timing motor in order to place the spring band 43 under tension as hereinafter described. By pushing downwardly on the button 48, the timer mechanism is wound and also started so that a predetermined time interval for the player to make a move is started.

The timing motor includes an outwardly extending drive shaft 50 which is preferrably of square shape in cross-section, in the manner as illustrated in FIGS. 6 and 7 of the drawings. Mounted on one end of the drive shaft 50 is an arm 52 which is moved by the drive shaft 50 from an upper or unactuated position (as illustrated in the solid lines of FIG. 7) to a lower or actuated position, (as illustrated in the phantom lines of FIG. 7). The arm 52 is moved by means of a pin 53 and the button 48 is a cap threadedly secured to an external threaded section 54 of the pin 53.

In order to start a timing cycle or predetermined time period for each player of the game to select and position a playing piece on the game board, one of the players will push downwardly on the cap 48. As this occurs, the pin 53 will push the arm 52 to the actuated position thereby rotating the shaft 50 and hence winding the spring 43. Thus, pushing down on the cap 48 causes the player to start the timing cycle and to simultaneously energize, e.g. wind up the timing mechanism. As the spring 43 unwinds, the arm 52 will be biased upwardly thereby pushing the pin 53 and the cap 48 upwardly.

When the arm 52 reaches its upper-most position which represents the end of a predetermined time period or timing cycle, it will contact a leaf terminal 58 forming part of a buzzer 60 and will generate a sound to advise the players of the end of the predetermined time period. The buzzer 60 is of conventional construction and may be battery-operated by means of batteries contained within a housing for the buzzer. Further, other forms of sound-generating means, as for example, a simple bell could be employed.

In order to provide for a handicap, a nut 62 is threadedly movable on the threaded section 54 of the pin 53. By downwardly rotating the nut 62 on the pin 53, a shorter time cycle will be created since the arm 52 will only be moved downwardly for a shorter distance. Similarly, by raising the position of the nut 62 on the pin 53, a longer time cycle will be provided. In this way, the players can adjust the time cycle in order to create the desired handicap. In like manner, the cap 48 could be capable of being threadedly positioned on the pin 54 in order to create the handicap. It should be understood that other forms of timers may be employed in place of the spring type timer just described and adapted for operation in the game apparatus.

In the embodiment of the invention as illustrated, the timer mechanism is mounted within the game board and the release button is conveniently available to all of the players. In this way, when one player finishes placing his or her selected playing piece on the playing board, he or she can push the button to wind up and also release the timer, so that the pre-selected time interval starts for the next player. Thus, each player is required to properly place his playing piece on the game board within the predetermined time interval. In the event the player does not place the playing piece upon the playing board within the predetermined time interval that player may lose his or her turn or otherwise may suffer a loss of score, or the like.

It should be understood that in the preferred embodiment, the timing mechanism is immediately mounted within the game board itself so as to be conveniently available to all of the players. However, it should also be understood that the timer could be provided separately from the game board.

The illustrated embodiment of this invention, is effective as a time reaction game in that each player starts at a desired position, and attempts to continue a strip of his or her playing pieces and further attempts to manipulate the path of movement of the strip of playing pieces so as to block further movement by each of the other players of the game. The time interval permitted by the timing mechanism is relatively short, e.g. 10 to 15 seconds, so that each player must operate fairly quickly. Moreover, by virtue of the time interval so that the players are required to quickly place the playing pieces on the game board, the various strips of playing pieces appear to move or grow much in the manner of an extending snake.

FIG. 1 illustrates two playing pieces by opponent players and where each is attempting to move to effectively block the path or movement of the opponent player. It should be observed that handicaps could be provided for more experienced or older players by shortening the time interval in which a player must select and properly place a playing piece on the playing board. For this purpose, the time may be provided with a mechanism for shortening or lengthening the time interval established for each play as aforesaid.

Thus, there has been illustrated and described a unique and novel game apparatus in which each player attempts to block movement of the playing pieces of one or more opponent players and which fulfills all of the objects and advantages sought therefore. It should be understood that many changes, modifications, variations and other uses and applications will become apparent to those skilled in the art after considering this disclosure and the accompanying drawings. Therefore, any and all such changes, modifications, variations, and other uses and applications which do not depart from the spirit and scope of the invention are deemed to be covered by the invention which is limited only by the following claims.

Having thus described my invention, what I desire to claim and secure by Letters Patent is:

1. A game apparatus in which each of a plurality of players attempt to extend a single layer horizontal chain of game pieces while blocking such chain extensions of the other players during alternate "turns" defined by a timer, said game apparatus comprising:

(a) a flat game board comprising a playing surface having a plurality of unit-sized squares forming a grid of longitudinal and transverse rows, with each of said unit-sized squares including a downwardly tapered recess, with the longitudinal distance between adjacent recesses being the same as the transverse distance between adjacent recesses;

(b) at least two sets of different sized playing pieces for each of the players of the game, each set having a standard length constituting multiples of said unit-sized squares, the top surface area of the individual units of each of said pieces generally comprising a shape essentially conforming to the size of each of said unit-sized squares on said game board, each unit length of said pieces defined by linear groove-like indicia extending perpendicular to the longitudinal edges of said piece, each unit of said pieces having a downwwardly tapered plug conforming to the shape of said recesses for allowing said pieces to slide down quickly and easily to detachably secure said playing pieces in selected areas on said playing surface enabling a player to quickly secure a piece to said board while reaching over previously positioned pieces without dislodging such other pieces that have already been secured to said board, with each playing piece having a low vertical profile with the vertical thickness of the playing piece which rests on top of the playing board surface less than each of the longitudinal and transverse dimensions of said unit-square of the playing board;

(c) a different player identification on each of said sets of said playing pieces, so that each player's pieces are visually distinguishable;

(d) said playing pieces and said game board playing surface being shaped, arranged and proportioned so that said pieces may be positioned on said board only perpendicular or parallel to said longitudinal and transverse rows in said board and so that two pieces of the same or different unit lengths which are placed on adjacent spaces in a selected path form a visually continuous chain;

(e) said playing pieces and said game board telescoping by said plug entering said recess to enable said game apparatus to be low in height for conveniently playing as well as storing said game apparatus; and (f) a timer mounted on said game board beneath the surface of said board said timer comprising: a spring wind-up motor including a spring; a rotatable drive shaft connected to said spring, said shaft winding said spring when rotated in one direction, said shaft rotated in the other direction by the unwinding of said spring; an arm one end of which is perpendicularly connected to said shaft such that said shaft is rotated by raising and lowering said arm, said arm being movable from an upper position to a lower position, said arm rotating said shaft to wind said spring when said arm is moved from an upper position to a lower position, said shaft rotated by said spring to raise said arm from a lower position to an upper position when said spring moves from a wound state to an unwound state; a pin extending through the surface of a portion of said game board and abutting said arm, said pin being operable to push said arm to its lower position and thereby wind said spring and start the running of said timer to start a new time period for a player when said pin is pushed by a player, said timer establishing a limited time interval for each player to rapidly select a playing piece of suitable length for quick positioning of said playing piece, with said pin constituting manually resetting means in the form of a push button for resetting the timer at the end of each player's turn without disrupting the pieces on the board with each player attempting to continue the extension of his or her playing pieces and to block the extension of the opposing player(s) by placing his or her playing pieces at selected locations before the end of said limited time interval.

2. The apparatus of claim 1 wherein said timer includes adjacent means for establishing different intervals of time and located on said pin for limiting the distance to which said pin can be pushed by a player, and stop means associated with the surface of said game board for abutting said adjustment means on said pin when said pin is pushed in order to stop the pin from further downward travel and thereby determine the amount said spring is wound, thereby allowing more skillful players to increase the pace, intensity, and excitement of the game by setting the timer to shorter time intervals.

3. The apparatus of claim 1 wherein said push button is positioned in the center of said game board surrounded by said grid of unit-sized squares so that it may be quickly, easily and equally accessed by all of the players of the game.

4. The apparatus of claim 1 further comprising a separate storage bin for each differently-sized piece located around the perimeter of said game board to enable each player to position his pieces conveniently in front of that player to standardize the proximity of each player's unplayed pieces relative to the playing board, and to facilitate the rapid determination of the proper piece to play, the quick execution of the location to grasp and play a particular piece, as well as to provide a storage location for the pieces when the game is not in use.

* * * * *